US009950714B2

(12) United States Patent
Kehl

(10) Patent No.: US 9,950,714 B2
(45) Date of Patent: Apr. 24, 2018

(54) ASSEMBLY DEVICE FOR A SIDE WALL CLADDING ELEMENT OF A RAIL VEHICLE

(71) Applicant: Siemens Aktiengesellschaft, Munich (DE)

(72) Inventor: Tobias Kehl, Schwanstetten (DE)

(73) Assignee: Siemens Aktiengesellschaft, Munich (DE)

( * ) Notice: Subject to any disclaimer, the term of this patent is extended or adjusted under 35 U.S.C. 154(b) by 290 days.

(21) Appl. No.: 14/780,777

(22) PCT Filed: Feb. 28, 2014

(86) PCT No.: PCT/EP2014/053942
§ 371 (c)(1),
(2) Date: Sep. 28, 2015

(87) PCT Pub. No.: WO2014/154441
PCT Pub. Date: Oct. 2, 2014

(65) Prior Publication Data

US 2016/0082982 A1 Mar. 24, 2016

(30) Foreign Application Priority Data

Mar. 28, 2013 (DE) ..... 10 2013 205 617

(51) Int. Cl.
*B61D 17/00* (2006.01)
*B61D 17/18* (2006.01)
*B61D 1/00* (2006.01)

(52) U.S. Cl.
CPC ..... *B61D 17/00* (2013.01); *B61D 1/00* (2013.01); *B61D 17/18* (2013.01)

(58) Field of Classification Search
CPC .... B61D 17/00; B61D 17/043; B61D 17/048; B61D 17/06; B61D 17/12; B61D 17/18; B61D 1/00
USPC ..... 105/401, 409, 410, 411, 423
See application file for complete search history.

(56) References Cited

U.S. PATENT DOCUMENTS 3,529,450 A 9/1970 Pellerin
6,327,981 B1 * 12/2001 Norregaard ..... B61D 17/043 105/396
2004/0012227 A1 1/2004 Robinson
2006/0210762 A1 * 9/2006 Tachauer ..... A44B 18/0049 428/99

(Continued)

FOREIGN PATENT DOCUMENTS

DE 1884477 U 12/1963
DE 1817911 A1 9/1973
DE 19616442 A1 10/1997

(Continued)

OTHER PUBLICATIONS

Copending U.S. Appl. No. 14/780,621, filed Feb. 2016 (US 2016/0031455).*

*Primary Examiner* — Mark T Le
(74) *Attorney, Agent, or Firm* — Laurence Greenberg; Werner Stemer; Ralph Locher

(57) ABSTRACT

A rail vehicle includes a side wall cladding element and a first profile rail fastened to the side wall cladding element. The first profile rail is provided for freely positioning and securing a first holder constructed to complement the first profile rail. The first holder in turn is connected to a framework or body shell of the rail vehicle.

9 Claims, 2 Drawing Sheets

(56) References Cited

U.S. PATENT DOCUMENTS

2011/0206877 A1 8/2011 Tada et al.

FOREIGN PATENT DOCUMENTS

DE 19933097 A1 2/2001
DE 102007024804 A1 11/2008

* cited by examiner

ASSEMBLY DEVICE FOR A SIDE WALL CLADDING ELEMENT OF A RAIL VEHICLE

BACKGROUND OF THE INVENTION

Field of the Invention

The invention relates to a side wall cladding element for a rail vehicle, and to a rail vehicle having a side wall cladding element.

It has been common practice to date for side wall cladding elements of a rail vehicle to be screwed to the body shell of the rail vehicle. One example therefor are the side wall claddings of the Combino by Siemens AG. In order for the side wall cladding elements to be connected to the body shell in a vandal-proof manner, a multiplicity of individual screw connections have to be provided. This requires a significant effort in assembly and in any disassembly.

BRIEF SUMMARY OF THE INVENTION

The invention is based on the object of proposing a side wall cladding fastening which is conducive to assembly, invisible from the passenger compartment of a rail vehicle, and vandal proof.

The object is achieved by the subject matter of the independent patent claim. Refinements and design embodiments of the invention are to be found in the features of the dependent patent claims.

A side wall cladding element for a rail vehicle in accordance with the invention, in particular a rail vehicle for passenger transit, for dedicated fastening to the rail vehicle comprises at least a first profile rail for freely positioning along the first profile rail a first holder, which is configured so as to be complementary to the first profile rail, and for fastening the first holder to the first profile rail. The first holder initially is to be freely positioned along the first profile rail and thereafter to be connected to the first profile rail at this position, for example by clamping the first holder to the first profile rail. The connection of first profile rail and first holder here is designed such that said connection is suitable for fastening the side wall cladding element having the at least one first holder to a body shell of the rail vehicle. The first holder, on its part, is then connected to the body shell of the rail vehicle, for example by way of a screw connection.

The body shell has a limited number of positions for first holders to be arranged on. On account of the first profile rail, however, side wall cladding elements may be shaped to various sizes and/or be variably disposed along the longitudinal axis of the rail vehicle.

In order for further cladding elements, in particular ceiling cladding elements, to be fastened to the side wall cladding element, the latter may have at least one further, second profile rail for freely positioning along the second profile rail a second holder, which is configured so as to be complementary to the second profile rail, and for fastening the second holder to the freely selected position of the second profile rail.

The side wall cladding element comprises both the first as well as the second profile rail, by way of which the further cladding elements are fastened to the side wall cladding element and thereby, by way of the side wall cladding element, are fastened to the body shell of the rail vehicle.

The first and/or the second profile rail are/is advantageously, disposed so as to be parallel with one another and/or parallel with the longitudinal axis of the rail vehicle.

In one refinement, the first and/or the second profile rail in the cross section are/is configured so as to be C-shaped. Where the first profile rail configured so as to be C-shaped has a vertically oriented C-shaped opening and/or where the second profile rail configured so as to be C-shaped has a horizontally oriented C-shaped opening, the opening of the first profile rail points, in particular, upwardly, and/or the opening of the second profile rail points laterally, in particular to the interior of the rail vehicle, such that the first holder is introducible from above into the first profile rail and is in particular longitudinally guided in the first profile rail in relation to the longitudinal axis of the rail vehicle, and/or the second holder is introducible from above into the second profile rail and is in particular longitudinally guided in the second profile rail in relation to the longitudinal axis of the rail vehicle.

According to one further refinement, the first and/or the second profile rail are/is disposed at the upper end of the side wall cladding element.

Advantageously, the first profile rail and the second profile rail are interconnected in a materially integral manner, in particular without visible joints. They are monolithically configured in that, for example, they are made from one casting; in particular both the first as well as the second profile rail are made from an extruded profile.

The side wall cladding element for cladding the side wall in the interior, in particular in the passenger compartment, of the rail vehicle extends in particular between the floor of the rail vehicle and a ceiling of the rail vehicle. As will be explained in more detail in the following, said side wall cladding element may have a height which is greater than the spacing between the ceiling and the floor of the interior of the rail vehicle.

In one further refinement it is provided that the side wall cladding element for fastening the side wall cladding element to a body shell of the rail vehicle has at least one hook for hooking the side wall cladding element into a guide. The guide for hooking the at least one hook of the side wall cladding element is configured so as to be complementary to the at least one hook and is connected to a body shell of the rail vehicle. According to the invention, the hook of the side wall cladding element is hooked into the guide, and the side wall cladding element is thus connected to the body shell of the rail vehicle.

The guide here may be shaped as an eyelet. Where this guide is a rail, the side wall cladding element is freely positionable along the rail. Said rail runs in particular parallel with the longitudinal axis of the rail vehicle.

In particular, the hook is configured in such a manner that it acts on the side wall cladding element at least in a perpendicular manner, such that the side wall cladding element is at least in this direction fixed to the body shell of the rail vehicle. Where the side wall cladding element on its part is vertically oriented in the rail vehicle, the hook counteracts horizontal displacement of the side wall cladding element away from the guide.

For example, the at least one hook of the side wall cladding element has a cutoff which for the guide to be hooked between the cutoff and the side wall cladding element is disposed so as to be spaced apart from the side wall cladding element.

According to one embodiment, the cutoff of the hook is elastically deformable, in particular in a direction which is perpendicular to the side wall cladding element. On account thereof, the guide is clampable between the side wall cladding element and the hook. By virtue of the cutoff being elastically deformed by hooking the guide such that the spacing of the cutoff from the side wall cladding element increases, the hook acts like a spring, on account of which the hook is biased toward the guide.

According to one further exemplary embodiment, the at least one hook of the side wall cladding element is open toward the bottom. The side wall cladding element is hooked from above into the guide and correspondingly hangs therein in the assembled state. In this way the hook is hooked into the guide counter to the direction of the dead weight of the side wall cladding element such that self-locking occurs and the side wall cladding element is blocked against sinking.

According to one further design embodiment of the rail vehicle, the at least one hook of the side wall cladding element is disposed at a lower end of the side wall cladding element. At least two or a plurality of hooks for hooking and fastening the side wall cladding element into at least one guide of the rail vehicle, which is configured so as to be complementary to the hook, are disposed at the lower end of the side wall cladding element, in particular for dedicated fastening of the side wall cladding element.

One configuration of the rail vehicle according to the invention provides that the rail vehicle has an interior, in particular a passenger compartment, having a floor, said floor being upwardly curved in the region of the side wall cladding element and the guide for hooking the hook being disposed on the periphery of said floor in the region of the side wall. The floor laterally extends at least up to the side walls of the rail vehicle, said side walls being at least partly formed by side wall cladding elements according to the invention. In particular, the floor extends beyond the side wall cladding elements. Said floor is laterally extended upward. The lateral peripheries of said floor thus form upwardly pointing closing edges. At least one guide for hooking at least one side wall cladding element is disposed on a lateral periphery of the floor. The lateral periphery of the floor is thus located between the body shell of the rail vehicle and the side wall cladding element, such that the cutoff of the hook is disposed on that side of the floor that is opposite the interior and in particular bears on the guide on that side. As has already been explained above, the guide is advantageously configured as a rail for freely positioning the side wall cladding element along the guide.

In one further refinement, the rail vehicle in the region of the side wall then comprises a seal which is disposed between the floor and the side wall cladding element and is biased in a sealing manner toward the side wall cladding element. The lip seal is fastened to the floor, for example, but may also be directly disposed on the guide. Additionally or alternatively, a seal which acts in an identical manner is disposed on the side wall cladding element. The lip seal in particular points to the inside of the rail vehicle.

Moreover, the side wall cladding element for dedicated fastening may be provided with a plurality of portions of a first component of a hook-and-loop fastener which is composed of two components, in particular in vertically disposed strips, in particular on the sides or peripheries of the side wall cladding element, in particular along the vertical axis thereof, so as to be perpendicular to the longitudinal axis of the rail vehicle. Portions of the other, second component of the hook-and-loop fastener are then correspondingly disposed on the body shell, for example on the door and/or window pillars. The first portions of the first component of the hook-and-loop fastener, as are the hooks for hooking the guide, are disposed on a rear side of the side wall cladding element which faces away from the interior, in particular the passenger compartment, of the rail vehicle. The second portions of the second component of the hook-and-loop fastener are correspondingly disposed on a side of the body shell which faces to the inside of the vehicle.

If and when the side wall cladding element during assembly is introduced in a hooking manner into the lower rail, the former may subsequently be fixed to the body shell by way of the hook-and-loop fasteners, so that said side wall cladding element may be subsequently fastened to the rail vehicle by way of the first holders.

A rail vehicle according to the invention, in particular a rail vehicle for passenger transit, comprises at least one side wall cladding element according to the invention and for fastening the side wall cladding element to a body shell of the rail vehicle at least one holder which is configured so as to be complementary to the first profile rail of the side wall cladding element and is fastened to the first profile rail and which on its part is, in particular releasably, connected to the body shell of the rail vehicle. The first holder is freely positionable along the first profile rail of the side wall cladding element.

In particular, the holder is clamped, wedged, or screwed to the profile rail and is likewise releasably connected to the body shell of the rail vehicle, for example by means of a screw connection.

Where only one holder is provided for fastening the side wall cladding element to a body shell of the rail vehicle, both the individual holder as well as the first profile rail are dimensioned such that they alone hold the side wall cladding element having a predetermined mass. In particular, however, two or a plurality of holders for fastening the side wall cladding element are connected to the first profile rail and the body shell of the rail vehicle.

Where additionally only one single hook is provided for hooking into a guide, said hook is also dimensioned for fastening the side wall cladding element together with the holder or the holders to the body shell of the rail vehicle. Where a plurality of hooks are provided, said hooks collectively hold the side wall cladding element and may thus be correspondingly designed.

As has already been explained above, the side wall cladding element comprises a second profile rail for fastening further cladding elements, in particular ceiling elements, in the rail vehicle. At least one second holder is designed in an analogous manner to the first holder, so as to be correspondingly complementary to the second profile rail of the side wall cladding element, and is connected to at least one further cladding element, in particular a ceiling element.

BRIEF DESCRIPTION OF THE SEVERAL VIEWS OF THE DRAWING

The invention permits numerous embodiments. The invention will be explained in more detail by means of the following figures in which in each case one exemplary design embodiment is illustrated. Identical elements are provided with the same reference signs in the figures, in which.

DESCRIPTION OF THE INVENTION

Figure 1:
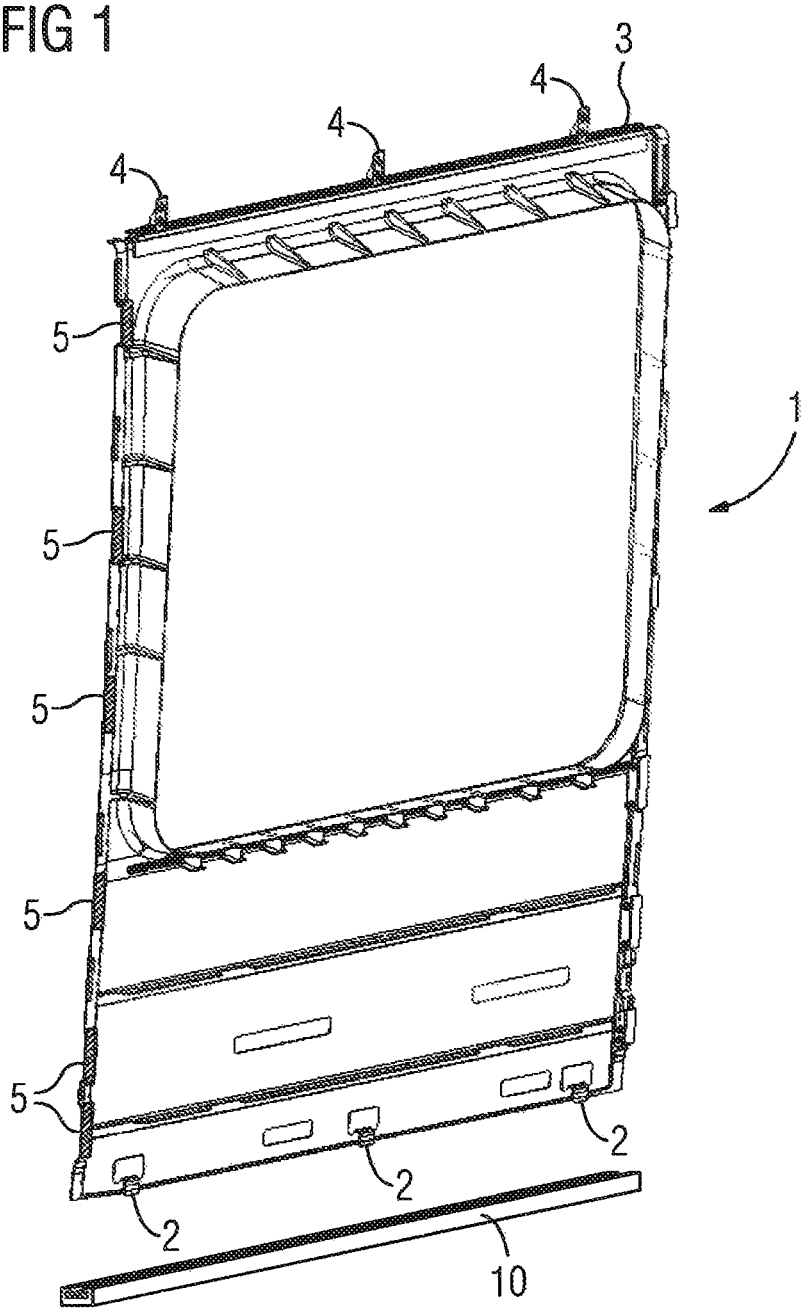
FIG. 1 shows in a perspective manner a side wall cladding element according to the invention, from that side that faces the outer skin of a rail vehicle.

A side wall cladding element according to the invention is illustrated in FIG. 1. Said side wall cladding element, on the lower end thereof, for dedicated fastening to a body shell of a rail vehicle has three hooks 2 for hooking the side wall cladding element 1 into a guide which is designed so as to be complementary to the hooks and which on its part is fastened to the body shell of the rail vehicle, on account of which the side wall cladding element 1 is also fastened to the body shell of the rail vehicle. As an object to be hooked, a guide 10, implemented for example as a rail which is parallel to the longitudinal axis of the rail vehicle, forms the counterpart to the hooks 2. The guide 10 is connected to the body shell of the rail vehicle, which is not illustrated in more detail here.

The side wall cladding element 1, at the upper end thereof, comprises a first profile rail 3 in which here three first holders 4 are guided. The first profile rail 3 serves for freely positioning the first holders 4, which are designed so as to be complementary to the first profile rail 3, along the first profile rail 3 and for fastening the first holders 4 to the first profile rail 3. The first holders 4 are designed so as to be releasably connectable to the first profile rail 3.

Said holders are clamped, wedged, or screwed to the first profile rail 3, for example. Additionally said holders are, in particular releasably, connectable to the body shell of the rail vehicle, for example by way of a screw connection.

Additionally, a plurality of portions of a first component of a hook-and-loop fastener which is composed of two components are laterally applied to the side wall cladding element 1, here in vertically running strips 5. Said portions likewise serve for fastening the side wall cladding element 1 to the body shell of the rail vehicle. The portions of the other, second component of the hook-and-loop fastener, which are correspondingly disposed on door and/or window pillars, are not shown here.

If and when the side wall cladding element 1 outlined here is assembled, initially the hooks 2 are hooked into the guide and the side wall cladding element 1 is aligned. First fixing is performed by means of hook-and-loop fasteners 5. The first holders 4 in the first profile rail 3 are subsequently connected to the body shell, in particular in a releasable manner by means of screw connections. Where a double-action or a second profile rail is provided, ceiling elements may be subsequently aligned on the former by way of two holders and be connected thereto, on account of which said ceiling elements by way of the side wall cladding element 1 are connected to the body shell of the rail vehicle.

Figure 2:
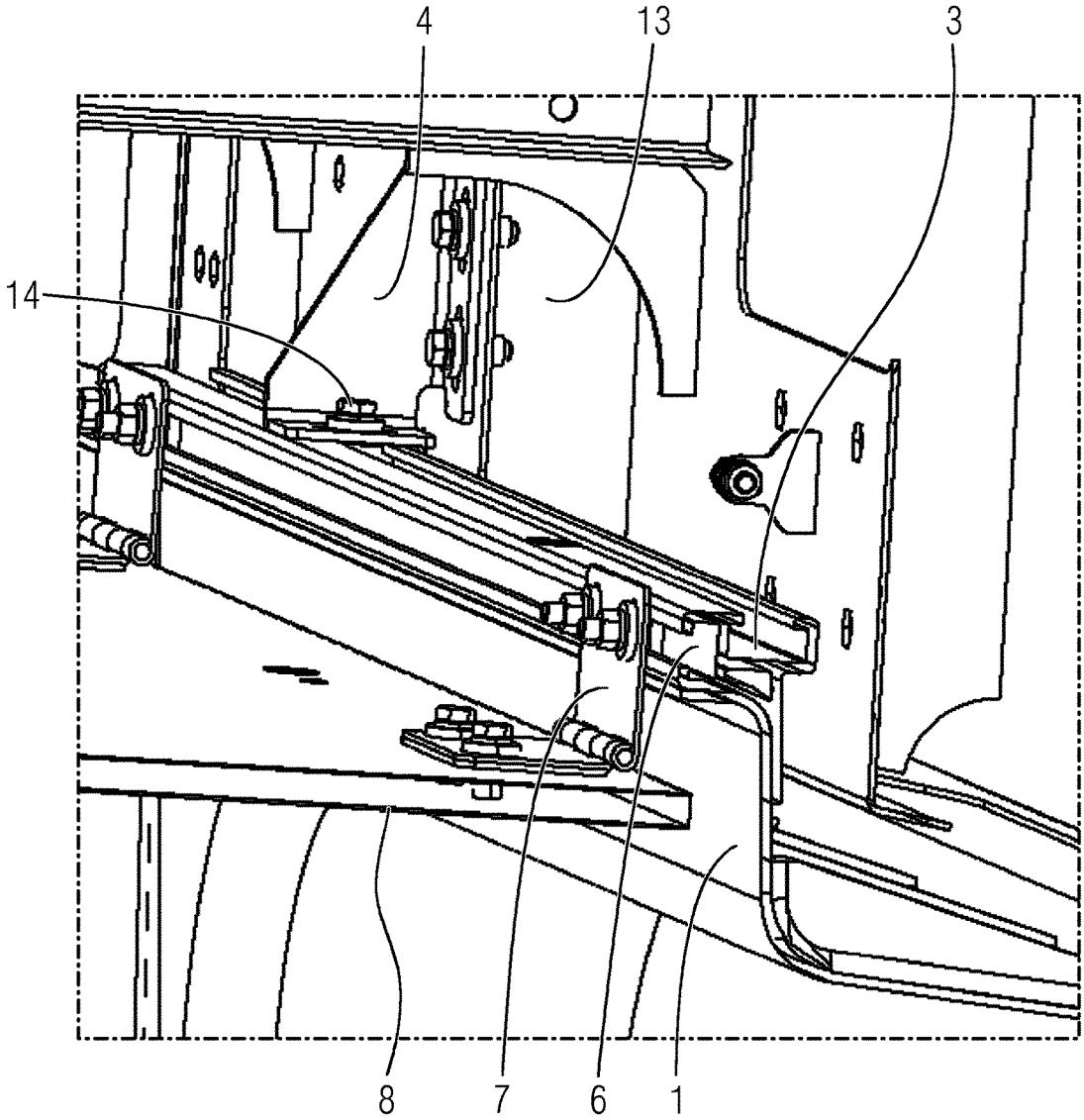
FIG. 2 shows a detailed section through a fastening mechanism of the side wall cladding element according to the invention.

FIG. 2 illustrates in a detailed manner fastening of an inventive side wall cladding element 1 to a body shell 13 of a rail vehicle. The side wall cladding element 1 at the upper end thereof has a first profile rail 3 which in the cross section is designed so as to be C-shaped, wherein the opening of the profile rail 3 which is designed so as to be C-shaped points upwardly, the C thus lying on its back. A first holder 4 is axially guided in the first profile rail 3 and is initially freely positionable therealong. By way of a clamp connection by means of a screw 14, said holder is then also releasably connected to the profile rail 3 and secured against being displaced along the first profile rail 3. At the same time, the first holder 4 is screwed to a door or window pillar of the body shell 13 of the rail vehicle. The side wall cladding element 1 is thus releasably connected to the body shell 13 of the rail vehicle. The first profile rail 3 here is designed so as to be complementary to the first holder 4, in order for the latter to be received so as to be free along the first profile rail 3.

The first profile rail 3 here has a C-shaped cross section. Said first profile rail may also be T-shaped, G-shaped, or shaped as a hat rail, the holder being correspondingly shaped. It is a common feature of the profile rails in the context of the invention that they initially serve for receiving and guiding a holder which is correspondingly designed so as to be complementary to the profile rail. Since the holders after assembly on the profile rails are no longer displaceable therealong, the profile rails act less as guide rails but rather as support rails.

Apart from the first profile rail 3, the side wall cladding element 1 has a further, second profile rail 6. The second profile rail 6 serves for fastening further cladding elements, presently ceiling cladding elements 8. In an analogous manner to the first profile rail 3, on the second profile rail 6 also, a second holder 7 which is designed so as to be complementary to the second profile rail is, in particular releasably, fastenable so as to be freely positionable along the second profile rail 6. The second holder 7 is connected to the at least one further cladding element, presently a ceiling cladding element 8. In this way, the ceiling cladding elements 8 are also connected to the body shell 13 of the rail vehicle.

The first and second profile rail 3 and 6 here are embodied so as to be unipartite. They have openings which face away from one another in a perpendicular manner. The first profile rail 3 has an opening which acts vertically, and the second profile rail 6 has an opening which acts horizontally. A vertical or vertically acting C-opening means that the C is open to the right or the left, in particular faces into the interior of the rail vehicle, as here. However, a horizontal or horizontally acting C-opening is present when the C is open toward the bottom or in particular toward the top. A vertical C opening here is not understood to be a slot which runs perpendicularly to the floor. A horizontal C opening does not apply to a slot which runs parallel with the floor, as is included in the second profile rail 6.

The invention claimed is:

1. A rail vehicle, comprising:

at least one side wall cladding element;

a first profile rail fastened to said at least one side wall cladding element;

at least one second profile rail fastened to said at least one side wall cladding element;

a first holder being complementary to said first profile rail and being freely positioned along said first profile rail for fastening said first holder to said at least one side wall cladding element, said first holder being connected to a body shell of the rail vehicle;

a second holder being complementary to said at least one second profile rail and being freely positioned along said at least one second profile rail for fastening said second holder to said at least one side wall cladding element; and at least one further cladding element being a ceiling cladding element connected to said second holder.

2. The rail vehicle according to claim 1, wherein said first profile rail and said second profile rail are interconnected in a materially integral manner.

3. The rail vehicle according to claim 1, wherein said first profile rail and said second profile rail are formed in one piece.

4. The rail vehicle according to claim 1, wherein at least one of said first or second profile rails is disposed at an upper end of said at least one side wall cladding element.

5. The rail vehicle according to claim 1, wherein said first holder is clamped to said first profile rail.

6. The rail vehicle according to claim 1, which further comprises first portions of hook-and-loop fasteners being fastened to said at least one side wall cladding element, said first portions being configured to be connected to second portions of said hook-and-loop fasteners being connected to the body shell of the rail vehicle.

7. The rail vehicle according to claim 1, which further comprises:

a guide connected to the body shell of the rail vehicle; and at least one hook to be hooked into said guide, said at least one hook being fastened to said at least one side wall cladding element.

8. The rail vehicle according to claim 7, wherein said at least one hook is disposed at a lower end of said at least one side wall cladding element.

9. A rail vehicle, comprising:

at least one side wall cladding element;

a first profile rail having a C-shaped cross section and being fastened to said at least one side wall cladding element;

at least one second profile rail having a C-shaped cross section and being fastened to said at least one side wall cladding element;

said C-shaped cross section of said first profile rail having an upwardly pointing opening, and said C-shaped cross section of said second profile rail having a laterally pointing opening;

a first holder being complementary to said first profile rail and being freely positioned along said first profile rail for fastening said first holder to said at least one side wall cladding element, said first holder being connected to a body shell of the rail vehicle;

a second holder being complementary to said at least one second profile rail and being freely positioned along said at least one second profile rail for fastening said second holder to said at least one side wall cladding element; and at least one further cladding element connected to said second holder.

* * * * *